US005113563A

United States Patent [19]

Feyerl et al.

[11] Patent Number: 5,113,563

[45] Date of Patent: May 19, 1992

[54] APPARATUS FOR NEEDLING A WEB

[75] Inventors: Günther Feyerl, Traun; Franz König, Linz, both of Austria

[73] Assignee: Textilmaschinenfabrik Dr. Ernst Fehrer Aktiengesellschaft, Leonding, Austria

[21] Appl. No.: 642,020

[22] Filed: Jan. 16, 1991

[30] Foreign Application Priority Data

Jan. 18, 1990 [AT] Austria ..... 102/90

[51] Int. Cl.[5] ..... D04H 18/00

[52] U.S. Cl. ..... 28/115

[58] Field of Search ..... 28/115, 107, 109, 114, 28/111, 108, 110, 113; 156/148

[56] References Cited

U.S. PATENT DOCUMENTS 3,122,815 3/1964 Smith, II ..... 28/115
3,199,166 8/1965 Petersik ..... 28/107
3,397,436 8/1968 Zocher ..... 28/115
3,538,564 11/1970 Skoler et al. ..... 28/107
4,937,924 7/1990 Leuchtenmüller ..... 28/111

*Primary Examiner*—Werner H. Schroeder
*Assistant Examiner*—Amy Brooke Vanatta
*Attorney, Agent, or Firm*—Collard, Roe & Galgano

[57] ABSTRACT

It is desired to use different needle pitches in the operation of an apparatus for needling a web without a need for replacing the needle board, the stripper and the optionally perforate backing. This is accomplished in that the holes provided in the needle board and serving to receive the needles, the holes of the perforate stripping plate and the holes in an optional perforate backing plate are arranged in at least two groups of holes and the holes in each row of each group are uniformly distributed over the working width of the apparatus.

4 Claims, 2 Drawing Sheets

APPARATUS FOR NEEDLING A WEB

BACKGROUND OF THE INVENTION

1. Field of the Invention

This invention relates to an apparatus for needling a web, comprising at least one needle board, which has holes arranged in rows and adapted to hold needles, a backing disposed opposite to the needle board, and a stripper, which is disposed between the backing and the needle board, wherein said stripper and optionally also the backing consists of a perforate plate.

2. Description of the Prior Art

In order to ensure that a web will be uniformly needled the points at which the web is penetrated by the needles must uniformly be distributed over the width of the web so that the pitch of the needles in the direction of the working width of the needling apparatus must be uniform and the pitch of the holes of the perforate plate or plates used as the stripper and optionally as the backing must be uniform too and equal to the needle pitch. Because design considerations require a minimum distance between adjacent needle-receiving holes of the needle board and between adjacent needle passage holes of the perforate stripper plate and of the optional perforate backing plate, said requirements can simply be met in that the holes are arranged with a uniform hole pitch in rows having a uniform row pitch and the holes in adjacent rows are offset from each other. Because the uniform needle pitch which will be obtained with needles arranged in a regular pattern will necessarily be disturbed if individual needles or rows of needles are omitted, a change of the needle pitch will require a replacement of the needle board, of the stripper and of the optionally perforate backing if a uniform needling is called for.

SUMMARY OF THE INVENTION

It is an object of the invention to avoid the above disadvantages and to provide a needling apparatus which is of the kind described first hereinbefore and which will assure a uniform needling by means of different numbers of needles whereas the needle board, the stripper and the backing need not be replaced.

This object is accomplished in accordance with the invention in that the holes in each of the components consisting of the needle board, the perforate stripper plate and any perforate backing plate are arranged in two groups of rows of holes, the holes in each group of rows are uniformly distributed over the working width, and the holes of the rows of one group are offset in the direction of the working width from the holes of rows of another group by a distance which differs from the hole pitch in the direction of the working width.

Because the holes are arranged in at least two groups of rows and have in each group of rows a uniform hole pitch over the working width, the needles may be inserted into the holes of only one of the groups of rows so that a uniform needling can be effected by the needles which are equal in number to the holes of that group. Because the holes in each row of one group are offset from the holes of each row of another group by a distance which differs from the hole pitch, it is possible to insert needles into the holes of both or all groups so that needles equal in number to the holes of all groups of rows can be used to needle the web. Owing to the provision of holes in at least two groups of rows with a uniform hole pitch in the rows of each group of rows and the arrangement of the holes of each row of the group with an offset from the holes of each row of the or each other group, the same structural elements can be used for different needle pitches so that the alteration of needling apparatuses for a needling with different needle pitches will greatly be simplified.

In order to avoid an irregular row pitch of the rows of holes and resulting irregularities in the needling of a web, it is recommended to arrange the rows of holes of each group of such rows in a uniform distribution over the working length in the direction of travel of the web. This means that in an apparatus in which the rows of holes are arranged in two groups, the rows of holes of the two groups will be arranged in alternation.

If the holes in each row of different groups of rows differ in number and all holes are provided with needles, certain irregularities in the overall distribution of the needles over the working width of the needling apparatus may be inevitable owing to the pitch ratio. If such irregularities are intolerable in certain applications, an arrangement will be preferred in which the rows of each group have the same hole pitch in the direction of the working width and the holes of the rows of each group are offset from those of the or each other group by a distance which is equal to the hole pitch divided by the number of groups of rows. In that case the space between the holes of each row of one group of rows will be passed through by the pitch lines of the holes of the other group of rows. In such an arrangement comprising two groups of rows the needle pitch will be equal to one-half of the hole pitch of one group if needles are inserted into all holes.

DETAILED DESCRIPTION OF THE PREFERRED EMBODIMENT

Figure 1:
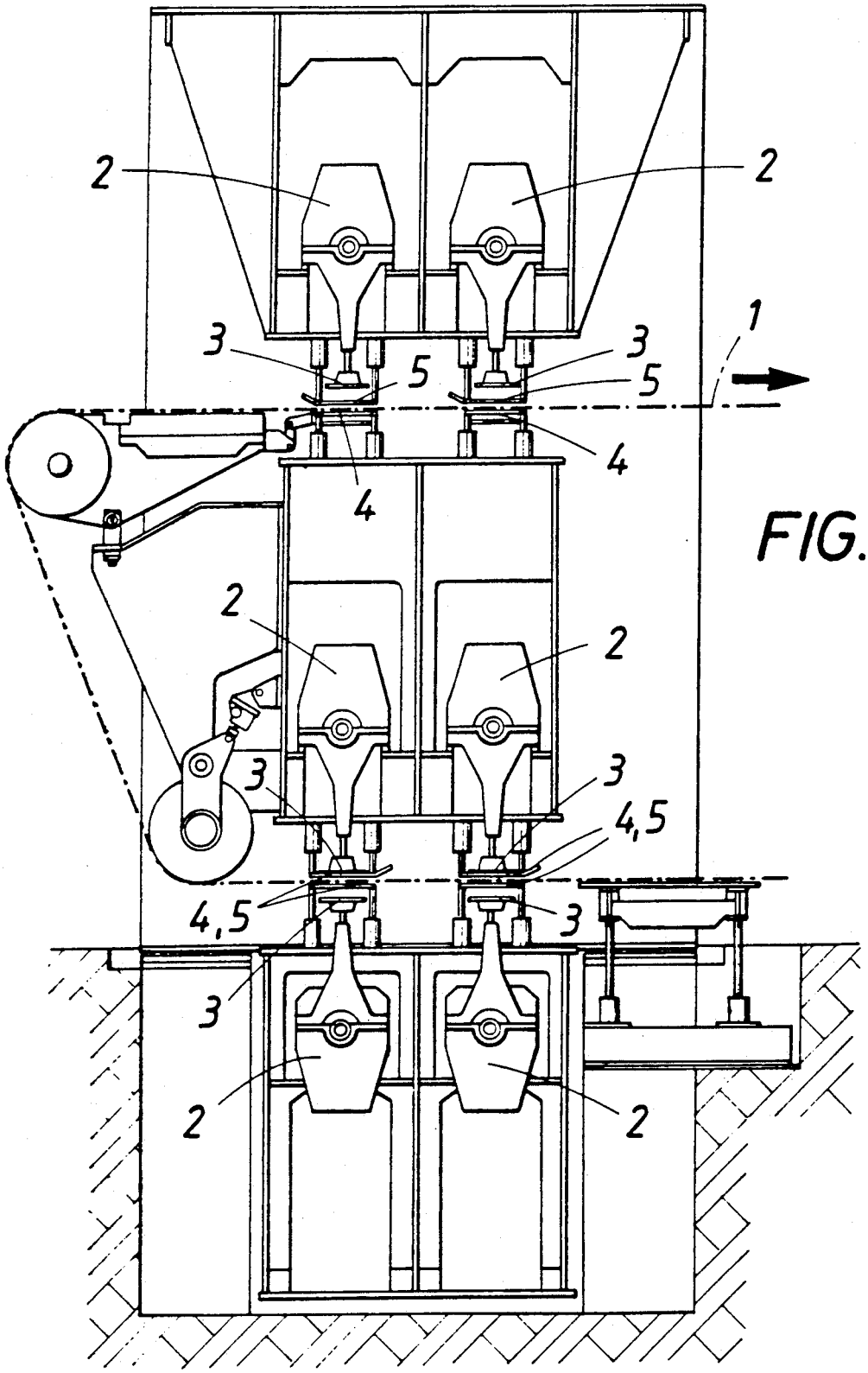
FIG. 1 is a diagrammatic longitudinal sectional view showing a needling machine comprising a plurality of needling apparatuses in accordance with the invention.

An illustrative embodiment of the invention will now be described more in detail with reference to the drawing.

The needling machine shown in FIG. 1 serves to needle a nonwoven web as a covering on a carrier web and to needle the resulting composite web 1, e.g., in the manufacture of needled felts for use in papermaking. The machine comprises a plurality of needling apparatuses 2, each of which constitutes a needling zone and comprises at least one needle board 3, which is adapted to be driven by an eccentric drive to reciprocate up and down, a backing 4, which is opposite to the needle board 3, and a stripper 5, which extends between the backing 4 and the needle board 3. The composite web 1 which is to be needled is continuously pulled through between the stripper 5 and the backing 4. As is apparent from FIG. 1 the upper course of the composite web 1 is needled on one side from above so that the covering nonwoven web is needled to the carrier web. The lower course of the composite web is subsequently needled from both sides by means of mutually opposite needling apparatuses, in which the backing of one needling apparatus constitutes the stripper of the opposite needling apparatus.

Figure 2:
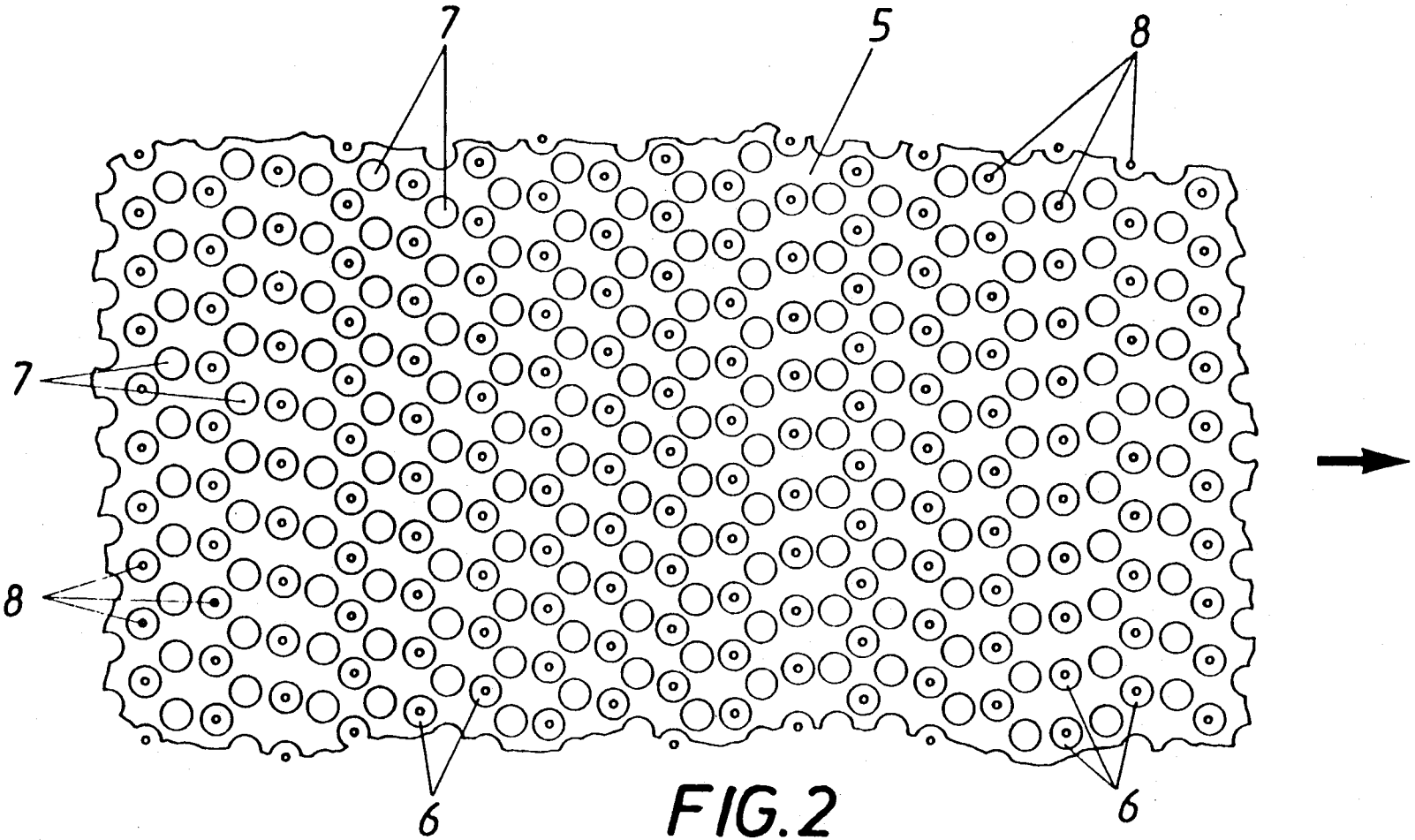
FIG. 2 is an enlarged top plan view showing a portion of a perforate plate which can be used as a stripper or optionally as a backing in the machine shown in FIG. 1.

Different requirements are to be met in the operation of the various needling zones of such a needling machine. For instance, the covering nonwoven web should be needled to the woven carrier with a much larger depth of penetration of the needles than for a surface-smoothening operation, for which a small depth of penetration will be required, because in the former case there is a risk of damage to the woven carrier owing to the larger depth of penetration. For this reason the several needling apparatuses 2 must have different needle pitches so that the needling apparatuses 2 may require different needle boards and corresponding strippers and backings. In order to avoid that expenditure and to provide different needle pitches in one set consisting of a needle board, stripper and an optionally perforate backing, the holes which in each needle board, stripper and optional perforate backing serve to fix the needles or as needle passages are arranged in at least two groups of rows 6 and 7 and the holes of each group of rows 6 or 7 are uniformly distributed over the working width of the needling apparatus 2. This is illustrated in FIG. 2 for a perforate stripper plate 5. All rows of the group 6 have a uniform hole pitch in the direction of the working width so that the operation of the associated needle board provided with needles 8 in the rows of that group will reliably result in a uniform needling of the web, particularly because the row pitch in each group is equal as the rows of the two groups are arranged in alternation. An operation of a needle board provided with needles in the holes of the group of rows 7 will similarly result in a uniform needling. For this reason the needle board may selectively be provided with needles in different numbers and with needles in different distributions without a need for a replacement of the needle board, the stripper or any perforate backing. Because the holes of each row of one group are offset in the direction of the working width from the holes of each row of the other group, a smaller needle pitch will be achieved if needles are provided in all holes. If in that case different numbers of holes are provided in each row of the two groups of rows the operation of a needle board provided with needles in all holes will inevitably involve a certain irregularity of the needle pitch. A perfectly uniform needle pitch will be achieved even when needles are provided in all holes if the number of needles per row is the same in the rows of both groups.

It will be understood that the invention is not restricted to the embodiment shown by way of example. For instance, the rows of holes may be arranged in more than two groups. Besides, it is not essential to provide each of the components consisting of the needle board, the stripper and the optional perforate backing with a combination of two or more hole pitches because the advantages afforded by such a combination of hole pitches may be utilized in each of said components alone.

We claim:

1. In an apparatus for needling a web, comprising a needle board extending over a predetermined working width and formed with a multiplicity of holes, the holes being arranged in rows extending over said working width and being adapted to hold needles, the needles being detachably fixed to said needle board and protruding therefrom on one side thereof, a backing facing and spaced from said needle board on said one side thereof and extending over said working width, a perforate stripper plate extending between said needle board and said backing over said working width and formed with a multiplicity of holes in register with holes of said needle board, wherein said needle board is reciprocable transversely to itself to move said needles held in holes of said needle board through holes in said stripper plate to said backing, the improvement residing in that said holes of said needle board and said holes of said stripper plate are arranged in a number of at least two groups of said rows, differing groups of said rows alternating with each other, the holes of each row of each group of rows have a uniform hole pitch along said row over said working width, and the holes of each of said rows of one of said groups of rows are offset along said row from the holes of each of the rows of another of said groups of rows by a distance differing from said hole pitch of the holes of the rows of said one group.

2. The improvement set forth in claim 1 as applied to a needling apparatus in which said backing comprises a perforate backing plate formed with holes in register with holes of said needle board and holes of said stripper plate, wherein said holes of said backing plate are arranged in at least two groups of said rows, the holes of each row of each group of rows of said backing plate have a uniform hole pitch along said row over said working width, and the holes of each of said rows of one of said groups of rows of said backing plate are offset along said row from the holes of each of the rows of another of said group of rows in said backing plate by a distance differing from said hole pitch of the holes of the rows of said one group of said rows of said backing plate.

3. The improvement set forth in claim 1, wherein said holes of said needle board and said holes of said stripper plate are regularly spaced apart in a direction which is transverse to said working width.

4. The improvement set forth in claim 1, wherein said holes of one of said group of rows have in each of said rows a hole pitch differing from the hole pitch of the holes in each of said rows of another of said groups of rows and the holes of each of said rows of one of said groups of rows are offset along said row from the holes of each of said rows of another of said groups of rows by a distance equalling the hole pitch of the holes of the rows of said one group divided by the number of groups of rows.

* * * * *